US008120059B2

(12) United States Patent
Watanabe et al.

(10) Patent No.: US 8,120,059 B2
(45) Date of Patent: Feb. 21, 2012

(54) NITRIDE SEMICONDUCTOR SUBSTRATE AND METHOD OF FABRICATING THE SAME

(75) Inventors: Kazutoshi Watanabe, Tsuchiura (JP); Takehiro Yoshida, Tsuchiura (JP)

(73) Assignee: Hitachi Cable, Ltd., Tokyo (JP)

( * ) Notice: Subject to any disclaimer, the term of this patent is extended or adjusted under 35 U.S.C. 154(b) by 210 days.

(21) Appl. No.: 12/585,109

(22) Filed: Sep. 3, 2009

(65) Prior Publication Data

US 2010/0096728 A1 Apr. 22, 2010

(30) Foreign Application Priority Data

Oct. 20, 2008 (JP) ..... 2008-269880

(51) Int. Cl.
*H01L 29/02* (2006.01)
*H01L 21/311* (2006.01)

(52) U.S. Cl. ..... 257/171; 257/189; 257/496; 257/618; 257/E31.019; 438/701

(58) Field of Classification Search ..... None
See application file for complete search history.

(56) References Cited

U.S. PATENT DOCUMENTS

| | | | | |
|---|---|---|---|---|
| 6,884,154 | B2 * | 4/2005 | Mizushima et al. | 451/44 |
| 7,195,545 | B2 * | 3/2007 | Nakayama et al. | 451/44 |
| 7,550,780 | B2 * | 6/2009 | Nakayama et al. | 257/171 |
| 7,986,030 | B2 * | 7/2011 | Meguro | 257/618 |
| 8,022,438 | B2 * | 9/2011 | Nakayama et al. | 257/171 |
| 2003/0153251 | A1 * | 8/2003 | Mizushima | 451/44 |
| 2004/0129940 | A1 * | 7/2004 | Iwase et al. | 257/48 |
| 2004/0195658 | A1 | 10/2004 | Nakayama et al. | |
| 2006/0194520 | A1 | 8/2006 | Nakayama et al. | |

FOREIGN PATENT DOCUMENTS

JP 2004-319951 11/2004

* cited by examiner

*Primary Examiner* — Alonzo Chambliss
(74) *Attorney, Agent, or Firm* — McGinn IP Law Group, PLLC

(57) ABSTRACT

A nitride semiconductor substrate includes a front surface, a rear surface on an opposite side to the front surface, and a first edge portion including a chamfered edge on the front surface. A ratio of an average surface roughness of the front surface to an average surface roughness of the first edge portion is not more than 0.01.

6 Claims, 5 Drawing Sheets

NITRIDE SEMICONDUCTOR SUBSTRATE AND METHOD OF FABRICATING THE SAME

The present application is based on Japanese patent application No. 2008-269880 filed on Oct. 20, 2008, the entire contents of which are incorporated herein by reference.

BACKGROUND OF THE INVENTION

1. Field of the Invention

This invention relates to a nitride semiconductor substrate and a method of fabricating the nitride semiconductor substrate. In particular, this invention relates to a nitride semiconductor substrate with a chamfered edge portion and a method of fabricating the nitride semiconductor substrate.

2. Description of the Related Art

In a Si substrate, a GaAs substrate etc. as a semiconductor substrate used for fabricating an electronic device etc., the shape recognition and the localization of the substrate are conducted by image processing upon the transport during the device fabrication process, or upon the appearance inspection during the device fabrication process and the shipping. The shape recognition and the localization of the substrate are frequently conduced by irradiating the substrate with visible light or infrared light and detecting light reflected by the substrate.

As a conventional nitride semiconductor substrate, a gallium nitride (GaN) semiconductor substrate is known which is formed circular in its top view and has an edge portion with a surface roughness (Ra) of 10 nm to 5 μm (e.g., see JP-A-2004-319951).

The nitride semiconductor substrate as described in JP-A-2004-319951 is formed such that the edge portion is smoothened so as to reduce the incidence of cracks and to enhance the fabrication yield of an electronic device in the electronic device fabrication process using the nitride semiconductor substrate.

However, since the nitride semiconductor substrate as described in JP-A-2004-319951 is transparent to (i.e., not reflective to) visible light and infrared light, it is impossible to achieve the shape recognition and the localization of the substrate by directly applying to the nitride semiconductor substrate the shape recognition method and the localization method used for a Si substrate, a GaAs substrate etc.

SUMMARY OF THE INVENTION

Therefore, it is an object of the invention to provide a nitride semiconductor substrate that its end portion can be recognized by using visible light or infrared light and a method of fabricating the nitride semiconductor substrate.

(1) According to one embodiment of the invention, a nitride semiconductor substrate comprises:

a front surface;

a rear surface on an opposite side to the front surface; and a first edge portion comprising a chamfered edge on the front surface, wherein a ratio of an average surface roughness of the front surface to an average surface roughness of the first edge portion is not more than 0.01.

In the above embodiment (1), the following modifications and changes can be made.

(i) The nitride semiconductor substrate further comprises:

a second edge portion comprising a chamfered edge on the rear surface, wherein a ratio of an average surface roughness of the rear surface to an average surface roughness of the second edge portion is not more than 0.01.

(ii) The first edge portion has a visible light transmissivity not more than 0.2 times that of the front surface.

(iii) The second edge portion has a visible light transmissivity not more than 0.2 times that of the rear surface.

(2) According to another embodiment of the invention, a method of fabricating a nitride semiconductor substrate comprises:

mirror finishing a front surface of a substrate comprising a nitride semiconductor; and forming a first edge portion by chamfering an edge of the front surface of the substrate, wherein the first edge portion is formed such that a ratio of an average surface roughness of the front surface to an average surface roughness of the first edge portion is not more than 0.01, and the first edge portion has a visible light transmissivity not more than 0.2 times that of the front surface.

In the above embodiment (2), the following modifications and changes can be made.

(iv) The method further comprises:

mirror finishing a rear surface on an opposite side to the front surface; and forming a second edge portion by chamfering an edge of the rear surface of the substrate, wherein the second edge portion is formed such that a ratio of an average surface roughness of the rear surface to an average surface roughness of the second edge portion is not more than 0.01, and the second edge portion has a visible light transmissivity not more than 0.2 times that of the rear surface.

Points of the Invention

According to one embodiment of the invention, a nitride semiconductor substrate has a chamfered portion at the end of the front surface such that the ratio of the average surface roughness (Ra) of the front surface to the average surface roughness (Ra) of the chamfered portion is not more than 0.01 so as to provide the chamfered portion with a visible light transmissivity not more than 0.2 times that of the front surface. Therefore, based on the difference in the visible light transmissivity therebetween, the contour of the nitride semiconductor substrate can be optically and clearly recognized at the boundary between the front surface and the chamfered portion by irradiating the front surface and the chamfered portion with visible light or infrared light.

BRIEF DESCRIPTION OF THE DRAWINGS

The preferred embodiments according to the invention will be explained below referring to the drawings.

DETAILED DESCRIPTION OF THE PREFERRED EMBODIMENTS

Embodiments

Figure 1A:
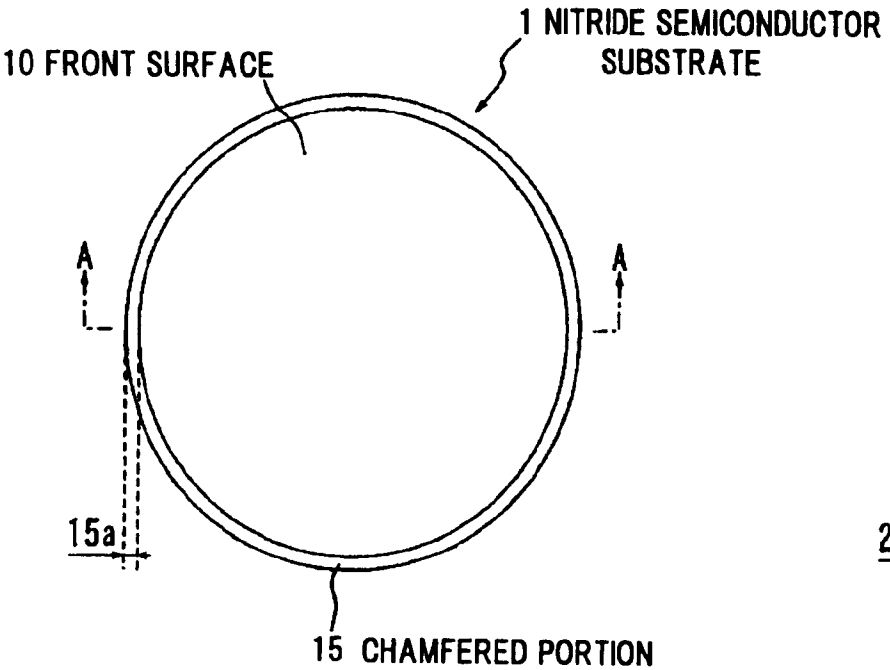
FIG. 1A is a top view schematically showing a front surface of a nitride semiconductor substrate in one embodiment according to the invention.
Figure 1B:
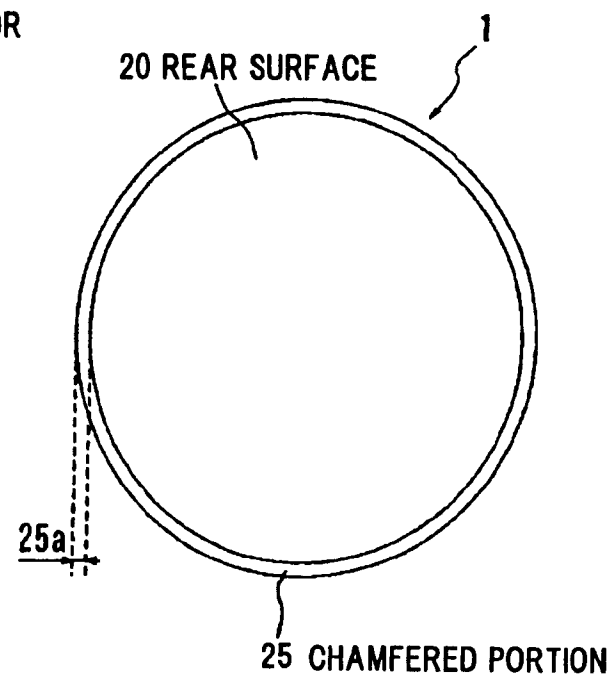
FIG. 1B is a bottom view schematically showing a rear surface of a nitride semiconductor substrate in one embodiment according to the invention.

FIG. 1A is a top view schematically showing a front surface of a nitride semiconductor substrate in the embodiment according to the invention. FIG. 1B is a bottom view schematically showing a rear surface of a nitride semiconductor substrate in the embodiment.

Structure of Nitride Semiconductor Substrate 1

The nitride semiconductor substrate 1 of the embodiment comprises a front surface 10 formed by mirror finishing, a chamfered portion 15 as a first edge portion formed by chamfering at least a part of an edge of the side of front surface 10 of the nitride semiconductor substrate 1, a rear surface 20 formed by mirror finishing at the opposite side of the front surface 10, and a chamfered portion 25 as a second edge portion formed by chamfering at least a part of an edge of the side of rear surface 20 of the nitride semiconductor substrate 1. The chamfered portion 15 has a predetermined chamfer width 15*a*. Similarly, the chamfered portion 25 has a predetermined chamfer width 25*a*.

Further, the nitride semiconductor substrate 1 can be formed of a general structural formula "$In_xAl_yGa_zN$" (in the formula, $0 \leqq x<1$, $0 \leqq y<1$, $0 \leqq z<1$, $x+y+z=1$). In case of forming the nitride semiconductor substrate 1 from GaN, the front surface 10 is, for example, a Ga surface, and the rear surface 20 is, for example, an N surface. Furthermore, the chamfered portion 15 has a range of area that is large enough to be seen by a same magnification stereomicrosope, and simultaneously small enough to maintain an effective area of the front surface 10 of the nitride semiconductor substrate 1 so as not to be reduced, the effective area being able to substantially make elements grow. For example, the chamfered portion 15 has a chamfer width 15*a* of not less than 0.1 mm and less than 1.0 mm, preferably, not less than 0.1 mm and not more than 0.5 mm in size in top view. Similarly, the chamfered portion 25 has a chamfer width 25*a* of not less than 0.1 mm and less than 1.0 mm, preferably, not less than 0.1 mm and not more than 0.5 mm in size in top view.

Further, the front surface 10 and the chamfered portion 15 has a predetermined average surface roughness (Ra) for the purpose that the border between the front surface 10 and the chamfered portion 15 and the chamfered portion 15 itself are clearly recognized by a microscope, and simultaneously for the purpose that occurrence of abnormal growth and occurrence of cracks due to the abnormal growth on the chamfered portion 15 are reduced even though a compound semiconductor is epitaxially-grown on the nitride semiconductor substrate 1, and an occurrence of chipping is reduced to the extent of substantially causing no problems even though the edge of the front surface 10 is chamfered by using a grinding stone having abrasive grains being large in diameter.

For example, the front surface 10 and the chamfered portion 15 has a structure that a ratio of an average surface roughness (Ra) of the front surface 10 to an average surface roughness (Ra) of the chamfered portion 15 is not more than 0.01, particularly, not less than 0.001 and not more than 0.01. Further, the chamfered portion 15 is formed so as to have a visible light transmissivity which is not more than 0.2 times that of the front surface 10. Furthermore, the visible light transmissivity means a light that has a wavelength of not less than 400 nm and not more than 780 nm. Similarly, the rear surface 20 and the chamfered portion 25 are formed so as to have a structure that a ratio of an average surface roughness (Ra) of the rear surface 20 to an average surface roughness (Ra) of the chamfered portion 25 is not more than 0.01, particularly, not less than 0.001 and not more than 0.01. Further, the chamfered portion 25 is formed so as to have a visible light transmissivity which is not more than 0.2 times that of the rear surface 20.

Figure 2:
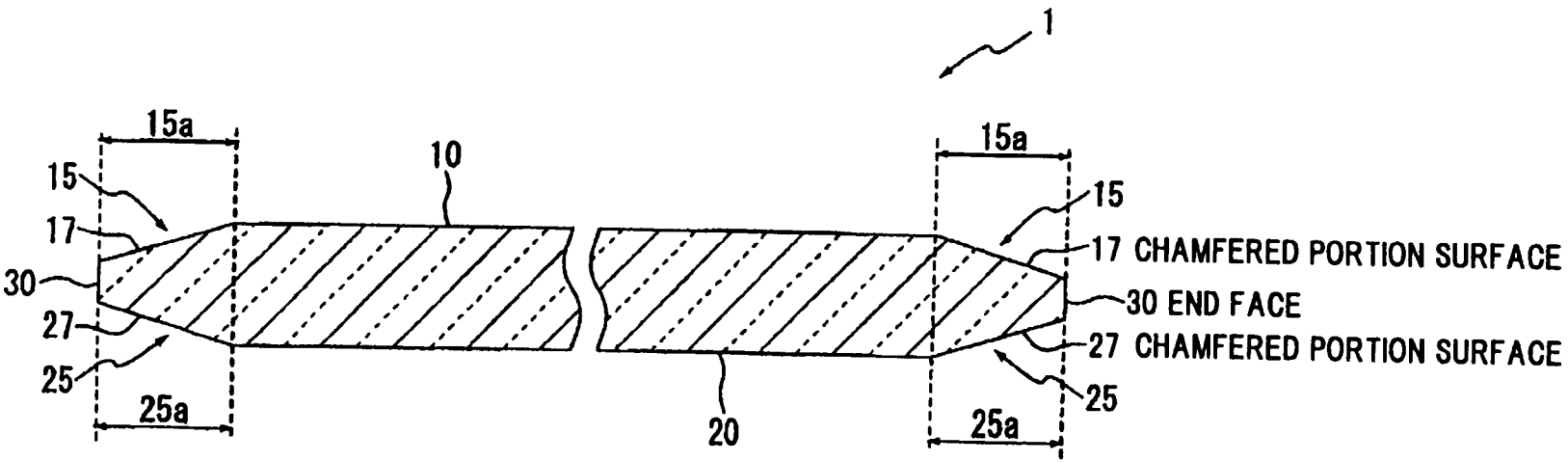
FIG. 2 is a transverse cross-sectional view schematically showing a nitride semiconductor substrate in one embodiment according to the invention.

If the front surface 10 and the chamfered portion 15 are formed so as to have a structure that a ratio of an average surface roughness (Ra) of the front surface 10 to an average surface roughness (Ra) of the chamfered portion 15 is not less than 0.001 and not more than 0.01, the difference between the front surface 10 and the chamfered portion 15 in the light transmissivity and/or reflectivity can be controlled to a certain range in which the front surface 10 and the chamfered portion 15 can be clearly distinguished, and the occurrence of chipping can be reduced to the extent of substantially causing no problems even though the abrasive grain of grinding stone has a large diameter, the stone being brought into contact with the edge of the side of front surface 10 of the nitride semiconductor substrate 1 in case of forming the chamfered portion 15. Further, a relationship about the average surface roughness between the rear surface 20 and the chamfered portion 25 (which has a chamfered portion surface 27, as shown in FIGS. 2) can be defined as in the case of the relationship between the front surface 10 and the chamfered portion 15 (which has a chamfered portion surface 17, as shown in FIG. 2). Furthermore, the average surface roughness (Ra) of the surface can be calculated by that a range of 50 μm×50 μm is measured by an atom force microscope according to JIS B 0601-1994.

FIG.2 is a transverse cross-sectional view schematically showing the nitride semiconductor substrate in the embodiment according to the invention.

In the embodiment, the chamfered portion 15 is formed so as to have a predetermined chamfer width 15*a*, and simultaneously to have a predetermined angle to a horizontal direction of the front surface 10. Further, the chamfered portion 25 is formed so as to have a predetermined angle to a horizontal direction of the rear surface 20 as in the case of the chamfered portion 15. Furthermore, an end face 30 of the nitride semiconductor substrate 1 is formed along a parallel direction to the normal directions of the front surface 10 and the rear surface 20.

Further, the chamfered portion 15 and the chamfered portion 25 can be also formed only in a part of the edges of the sides of the front surface 10 and the rear surface 20 of the nitride semiconductor substrate 1 respectively. For example, in case that a linear portion such as an orientation flat which shows a plane direction of the nitride semiconductor substrate 1 is formed in the edge of the nitride semiconductor substrate 1, the chamfered portion 15 and the chamfered portion 25 can be formed in the region of the orientation flat. Further, in case that cut portions such as notches are formed in the edge of the nitride semiconductor substrate 1, the chamfered portion 15 and the chamfered portion 25 can be also formed only in the region of the cut portions.

Method of Fabricating Nitride Semiconductor Substrate 1

Figure 3:
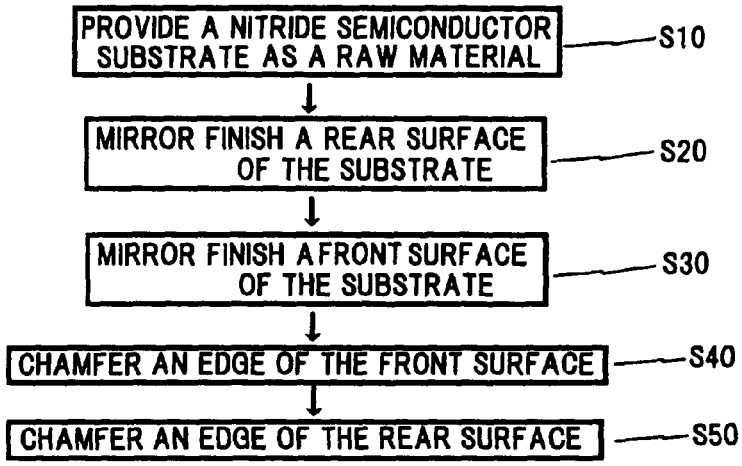
FIG. 3 is a flow chart schematically showing a fabrication process of a nitride semiconductor substrate in one embodiment according to the invention.

FIG. 3 is a flow chart schematically showing a fabrication process of the nitride semiconductor substrate in the embodiment according to the invention.

First, a nitride semiconductor substrate to become a raw material of the nitride semiconductor substrate 1 is prepared (a step of preparation of nitride semiconductor substrate: step 10, hereinafter, the step will be abbreviated to "S"). For example, a preprocessing is carried out on a sapphire substrate which is a heterogeneous substrate by Epitaxial Lateral Overgrowth (ELO) method or the like. Subsequently, a thick film of the nitride semiconductor is formed by Hydride Vapor Phase Epitaxy (HVPE) method. Next, the sapphire substrate is eliminated by a mechanical grinding or a laser separation method. By this, a nitride semiconductor freestanding substrate is obtained as a nitride semiconductor substrate to be a raw material. Further, the nitride semiconductor substrate to be a raw material can be also obtained by that ingot of the nitride semiconductor is grown and sliced.

Next, mirror finishing is carried out on the rear surface (N-surface in case that the nitride semiconductor substrate is GaN substrate) of the nitride semiconductor substrate obtained (the step of mirror finishing the rear surface: S20). The mirror finishing is carried out by that first, a grinding or a lapping (using GC#800 etc.) is carried out to the rear surface so as to eliminate the concavity and convexity of the rear surface. Next, a polishing is carried out to the rear surface so that the mirror finishing of the rear surface is achieved. Next, the mirror finishing is carried out on the front surface (Ga-surface in case that the nitride semiconductor substrate is GaN substrate) of the nitride semiconductor substrate of which the rear surface has been subjected to the mirror finishing (the step of mirror finishing the front surface: S30). The mirror finishing of the front surface can be carried out as in the case of the rear surface.

Next, chamfering is carried out to the edge of the front surface side of the nitride semiconductor substrate (a step of forming of first edge: S40). The chamfering is carried out by the grinding or lapping. Further, the chamfering is carried out so that the chamfered portion 15 has a predetermined shape, a predetermined surface roughness, and a predetermined visible light transmissivity. Next, the chamfering is carried out to the edge of the rear surface side of the nitride semiconductor substrate (a step of forming of second edge: S50). The chamfering of the edge of the rear surface can be carried out as in the case of the front surface. In the embodiment, the chamfering of the edges of the front surface and the rear surface is carried out separately and independently from the mirror finishing of the front surface and the rear surface. By this, the nitride semiconductor substrate 1 according to the embodiment can be obtained.

Figure 4:
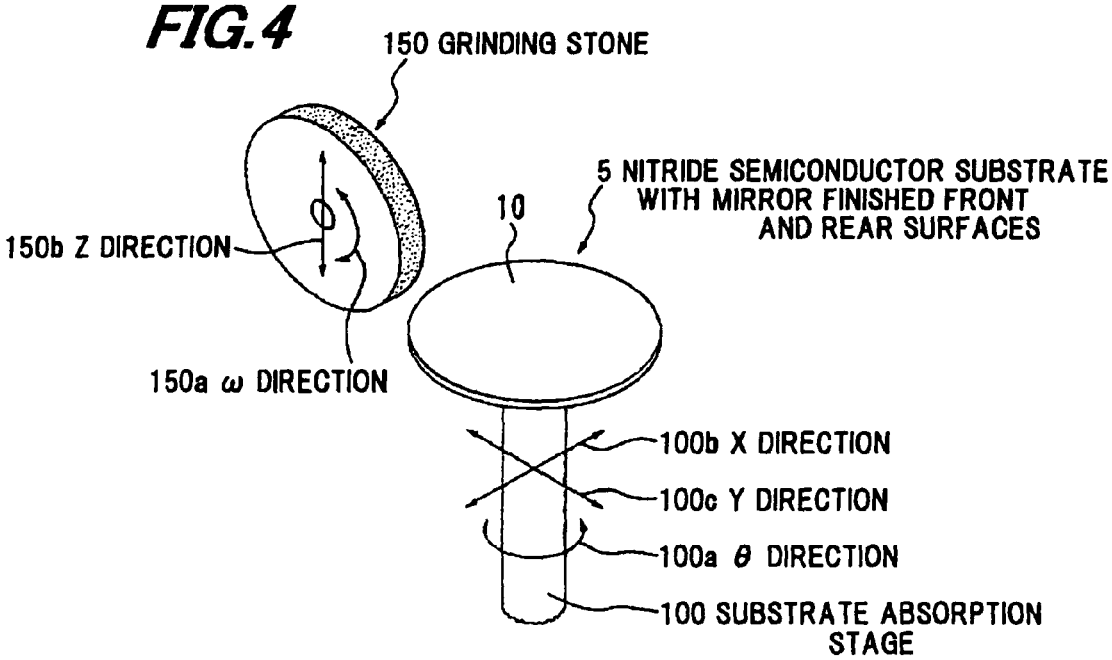
FIG. 4 is an explanatory view schematically showing a method of chamfering in one embodiment according to the invention.

FIG. 4 is an explanatory view schematically showing a method of chamfering in the embodiment according to the invention.

The chamfering is carried out such that a nitride semiconductor substrate 5 with front and rear surfaces mirror finished 5 is mounted on a substrate absorption stage 100, and the nitride semiconductor substrate 5 is moved relative to a grinding stone 150 and simultaneously the grinding stone 150 is made to contact an edge of the front surface 10 or the rear surface 20 of the nitride semiconductor substrate 5 mounted on the substrate absorption stage 100.

In the chamfering, the grinding stone 150 rotates at a predetermined rotation speed in an ω direction 150*a*. On the other hand, the nitride semiconductor substrate 5 rotates in a θ direction 100*a* due to that the substrate absorption stage 100 rotates at a predetermined rotation speed in a θ direction 100*a*. Further, the grinding stone 150 is movable in a z direction 150*b* and the substrate absorption stage 100 is movable in an x direction 100*b* and in a y direction 100*c*.

The chamfering is carried out such that the grinding stone 150 which rotates is made to contact an edge of the front surface 10 or the rear surface 20 and simultaneously an amount of movement is adjusted in the x direction 100*b*, the y direction 100*c* and the z direction 150*b* respectively. And, the chamfered portion 15 and the chamfered portion 25 is formed, so as to have a predetermined inclination and a predetermined surface roughness, and have a width of not less than 0.1 mm and not more than 1.0 mm in a direction from an end of the edge of the side of the front surface 10 or the rear surface 20 to a center of the substrate at a top view. Further, the surface roughness of the chamfered portion 15 and the chamfered portion 25 is adjusted by that the roughness of the grinding stone 150 is changed.

For example, the chamfered portion 15 is formed by chamfering the edge of the front surface 10, the chamfered portion 15 having an average surface roughness which achieves a relationship that a ratio of the average surface roughness of the front surface to the average surface roughness of the chamfered portion 15 is not more than 0.01, and a visible light transmissivity of the chamfered portion 15 is not more than 0.2 times that of the front surface 10. Similarly, the chamfered portion 25 is formed by chamfering the edge of the rear surface 20, the chamfered portion 25 having the average surface roughness which achieves a relationship that a ratio of the average surface roughness of the rear surface to the average surface roughness of the chamfered portion 25 is not more than 0.01, and a visible light transmissivity of the chamfered portion 25 is not more than 0.2 times that of the rear surface 20.

Advantages of the Embodiment

The nitride semiconductor substrate 1 according to the embodiment comprises the chamfered portion 15 formed in a predetermined range in a direction from an end of the front surface 10 to a center of the nitride semiconductor substrate and having an average surface roughness which achieves a relationship that a ratio of the average surface roughness of the front surface to the average surface roughness of the chamfered portion 15 is not more than 0.01 and a visible light transmissivity of the chamfered portion 15 is not more than 0.2 times that of the front surface 10, so that the contour of the nitride semiconductor substrate 1 at the border between the front surface 10 and the chamfered portion 15 can be optically and clearly recognized in case that the front surface 10 and the chamfered portion 15 are irradiated with a visible light or an infrared light. By this, according to the nitride semiconductor substrate 1 of the embodiment, for example, by using an optical microscope or an image processor mounted on a stepper device, a mask aligner device or the like, the contour of the nitride semiconductor substrate 1 can be easily recognized, and simultaneously the end portion (the edge portion) of the nitride semiconductor substrate 1 can be easily recognized.

Further, the nitride semiconductor substrate 1 according to the embodiment comprises the chamfered portion 25 formed in a predetermined range in a direction from an end of the rear surface 20 to a center of the nitride semiconductor substrate and having an average surface roughness which achieves a relationship that a ratio of the average surface roughness of the rear surface to the average surface roughness of the chamfered portion 25 is not more than 0.01 and a visible light transmissivity of the chamfered portion 25 is not more than 0.2 times that of the rear surface 20, so that the contour of the nitride semiconductor substrate 1 at the border between the rear surface 20 and the chamfered portion 25 and the chamfered portion 25 can be optically and clearly recognized in case that the rear surface 20 and the chamfered portion 25 are irradiated with a visible light or an infrared light. By this, according to the nitride semiconductor substrate 1 of the embodiment, for example, in case that a rear surface alignment is carried out by using an optical microscope or an image processor mounted on a stepper device, a mask aligner device or the like, the contour of the nitride semiconductor substrate 1 can be easily recognized, and simultaneously the end portion (the edge portion) of the nitride semiconductor substrate 1 can be easily recognized.

Further, since the contour of the nitride semiconductor substrate 1 can be easily recognized by a visible light or an infrared light, the nitride semiconductor substrate 1 according to the embodiment can be easily applied to a location detection device, a carrier device and an evaluation device of the semiconductor substrate, without using a special light source for recognition of contour (for example, an ultraviolet light having larger energy than a band gap of a nitride semiconductor constituting a nitride semiconductor substrate).

Modification of Embodiment

Figure 5:
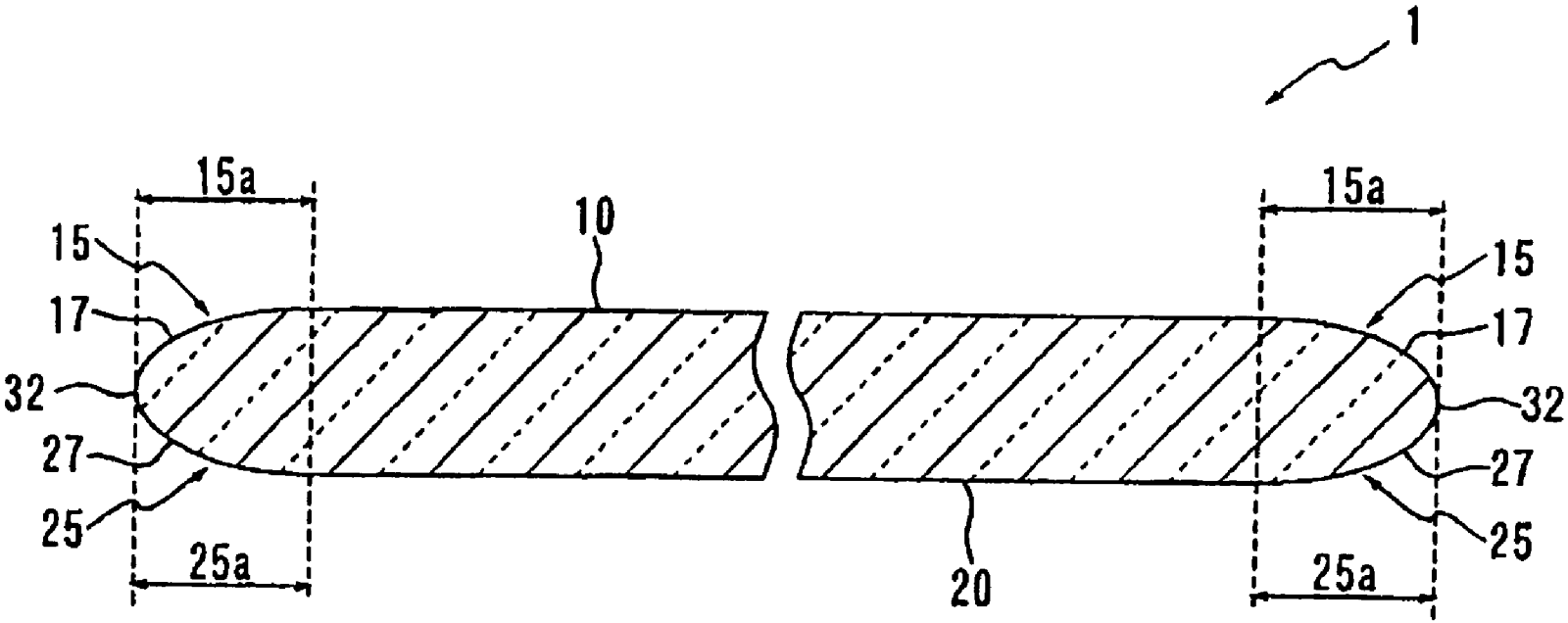
FIG. 5 is a transverse cross-sectional view schematically showing a nitride semiconductor substrate in one modification of embodiment according to the invention.

FIG. 5 is a transverse cross-sectional view schematically showing a nitride semiconductor substrate in one modification of the embodiment according to the invention.

The nitride semiconductor substrate 1 according to the modification of the embodiment has almost the same structure as that of the nitride semiconductor substrate according to the embodiment, except for being different in the shape of the end portion. Therefore, the detail explanation will be omitted with the exception of the different point.

Particularly, the nitride semiconductor substrate 1 according to the modification of the embodiment comprises round portions 32 at the ends of the chamfered portion 15 and the chamfered portion 25, the round portion 32 being formed by a round processing. In this case, each of the chamfered portion 15 and the chamfered portion 25 is formed by a carved surface having a predetermined curvature. The nitride semiconductor substrate 1 comprises the round portion 32 so that the substrate 1 can be prevented from occurrence of break and chip.

Figure 6:
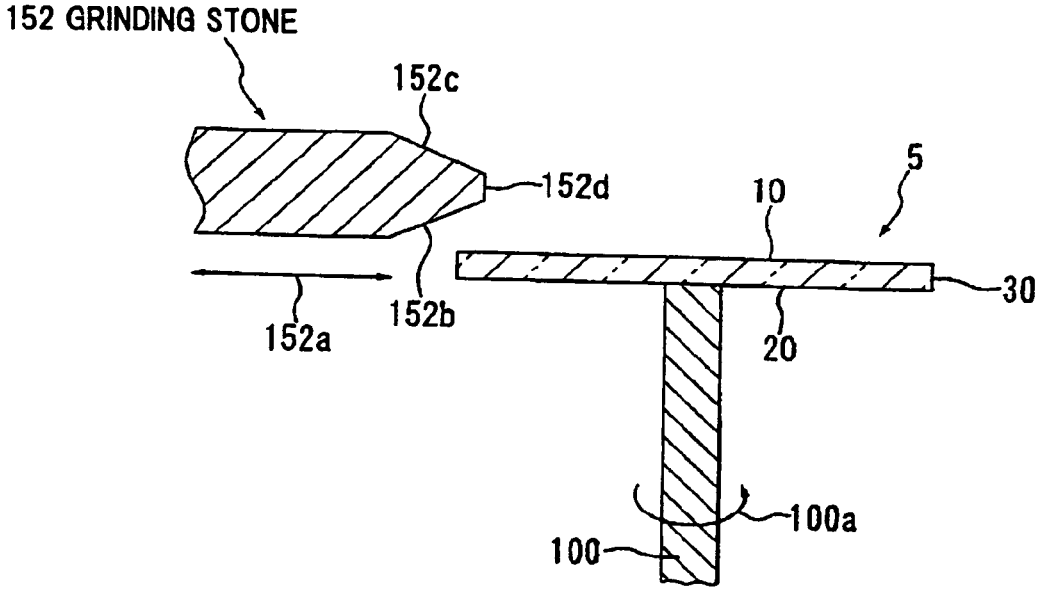
FIG. 6 is a transverse cross-sectional view schematically showing a method of chamfering in a modification of the embodiment according to the invention.

FIG. 6 is a transverse cross-sectional view schematically showing a method of chamfering in a modification of the embodiment according to the invention.

The chamfering in the modification of the embodiment is carried out by using a grinding stone 152 which has a shape preliminarily formed so as to respond to that of the edge of the nitride semiconductor substrate 1 to be fabricated. Namely, the grinding stone 152 comprises a grinding stone surface 152*b* having a shape formed so as to respond to that of the chamfered portion 15 of the nitride semiconductor substrate 1 and a grinding stone surface 152*c* having a shape formed so as to respond to that of the chamfered portion 25, and is movable along a direction 152*a*. Further, the grinding stone end portion 152*d* of the grinding stone 152 has a plane along a direction perpendicular to the direction 152*a*. Further, the grinding stone end portion 152*d* can be formed by a plane having a predetermined curvature.

EXAMPLES

Nitride semiconductor substrates according to Examples were fabricated based on the method of fabricating the nitride semiconductor substrate according to the embodiment of the invention. Particularly, nitride semiconductor substrates according to Examples 1 to 3 described below were fabricated. Further, all of the nitride semiconductor substrates according to Examples 1 to 3 and Comparative Examples 1 to 3 have a diameter of 50 mm.

Example 1

Mirror finishing was carried out to the front surface 10, the chamfered portion 15, the rear surface 20 and the chamfered portion 25 respectively, and simultaneously the chamfer width 15*a* and the chamfer width 25*a* were defined to 0.5 mm. And, a ratio of an average surface roughness (Ra) of the front surface 10 to an average surface roughness (Ra) of the chamfered portion 15 was defined to 0.001. Further, the average surface roughness (Ra) of the front surface 10 was defined to 3 nm.

Example 2

A nitride semiconductor substrate was fabricated as in the case of Example 1 except that the ratio of the average surface roughness (Ra) of the front surface 10 to the average surface roughness (Ra) of the chamfered portion 15 was defined to 0.01.

Example 3

A nitride semiconductor substrate was fabricated as in the case of Example 1 except that the chamfer width 15*a* and the chamfer width 25*a* were defined to 0.9 mm and simultaneously the ratio of the average surface roughness (Ra) of the front surface 10 to the average surface roughness (Ra) of the chamfered portion 15 was defined to 0.01.

Particularly, after the mirror finishing was carried out to the front surface 10 and the rear surface 20 of a nitride semiconductor substrate to be fabricated, the nitride semiconductor substrate according to Example 1 was fabricated by using the grinding stone 150 having a diameter of abrasive grain of # 400, which is used for the chamfering to form the chamfered portion 15 and the chamfered portion 25. Further, the nitride semiconductor substrates according to Examples 2 to 3 were fabricated by that the ratio of the average surface roughness (Ra) was changed due to that the diameter of abrasive grain of the grinding stone 150 was defined to # 2000. Furthermore, the chamfer width 15*a* and the chamfer width 25*a* were defined to 0.5 mm (Examples 1 to 2) and 0.9 mm (Example 3) by adjusting an amount of feed in the z direction 150*b* of the grinding stone 150 and an amount of feed in the x direction 100*b* of the substrate absorption stage 100.

Comparative Example 1

On the other hand, as Comparative Example 1, a nitride semiconductor substrate was fabricated by that the grinding stone 150 having a diameter of abrasive grain of # 200 used for the chamfering to form the chamfered portion 15 was used, so that the ratio of the average surface roughness (Ra) of the front surface 10 to the average surface roughness (Ra) of the chamfered portion 15 was defined to 0.03.

Comparative Example 2

Further, as Comparative Example 2, a nitride semiconductor substrate was fabricated by that the mirror finishing was carried out to the front surface 10 and the rear surface 20, but the chamfering was not carried out (the chamfer width 15*a* and the chamfer width 25*a*=0.0 mm).

Comparative Example 3

Furthermore, as Comparative Example 3, a nitride semiconductor substrate was fabricated by that the grinding stone 150 having a diameter of abrasive grain of # 3000 used for the chamfering to form the chamfered portion 15 was used, so that the ratio of the average surface roughness (Ra) of the front surface 10 to the average surface roughness (Ra) of the chamfered portion 15 was defined to 0.0005.

The nitride semiconductor substrates according to Examples 1 to 3 and Comparative Examples 1 to 3 were mounted on a stage made of SUS via a black plastic board respectively. The nitride semiconductor substrates were imaged by using a stereomicroscope on which a CCD camera was mounted, the CCD camera being capable of imaging the whole region of 50 mm in diameter on the same image plane. Further, the stereomicroscope which has a white ring light source was used.

Here, the more the surface roughness of the front surface 10 and the chamfered portion 15, or the rear surface 20 and the chamfered portion 25 is increased, the more the scattering and/or reflection of visible light and/or infrared light on the respective surfaces are increased. In this case, the visible light and/or infrared light which penetrate the nitride semiconductor substrate decrease, so that the visible light and/or infrared light which are absorbed in the black plastic board also are decreased.

Therefore, if the ratio of the average surface roughness (Ra) of the front surface 10 to the average surface roughness (Ra) of the chamfered portion 15 is decreased, the visible light transmissivity of the chamfered portion 15 to that of the front surface 10 is decreased, so that the reflected light from the chamfered portion 15 which enters into a CCD camera for imaging the surface of the nitride semiconductor substrate is increased. By this, brightness of the chamfered portion 15 and contrast (difference of brightness) between the front surface 10 and the chamfered portion 15 are increased.

Further, the contour of the nitride semiconductor substrate is recognized by that a binarization processing is applied to the images taken by the CCD camera. Here, if a visible light transmissivity of the chamfered portion 15 is not more than 0.2 times that of the front surface 10, the contrast between the front surface 10 and the chamfered portion 15 is increased, so that the contrast of the contour becomes clear. This commonly happens when a visible light transmissivity of the chamfered portion 25 is not more than 0.2 times that of the front surface 20. For example, in Examples 1 to 3 and Comparative Examples 1 to 3, the visible light transmissivity of the front surface 10 is 65% to 70%, while the visible light transmissivity of the chamfered portion 15 is not more than 10%, so that the visible light transmissivity of the chamfered portion 15 is not more than 0.2 times the visible light transmissivity of the front surface 10. In this case, the chamfered portion 15 was visually observed in a state of white turbidity (a state of opacity) under a fluorescent lamp.

Particularly, with regard to the taken images, the surfaces of the nitride semiconductor substrates according to Examples 1 to 3 and Comparative Examples 1 to 3 and the surrounding plastic board were observed in a state of low brightness (blackish color) and the chamfered portion 15 was observed in a state of high brightness white color or white turbid color). The binarization processing was applied to 256 colors bitmap data of the taken images, and then recognition results of the contours of the nitride semiconductor substrates were compared.

Evaluation results of the substrate contour recognition by the binarization of the respective nitride semiconductor substrates according to Examples 1 to 3 and Comparative Examples 1 to 2 are shown in Table 1.

TABLE 1

| | Example 1 | Example 2 | Example 3 | Comp. Ex. 1 | Comp. Ex. 2 |
|---|---|---|---|---|---|
| Chamfer width (mm) | 0.5 | 0.5 | 0.9 | 0.9 | 0.0 |
| Roughness of surface 10/ roughness of chamfered portion 15 | 0.001 | 0.01 | 0.01 | 0.03 | — |
| Rate of no contour recognition (%) | 4 | 5 | 8 | 12 | 22 |

[Notes]
Comp. Ex.: Comparative Example

For the nitride semiconductor substrates in Examples 1 to 3, a ratio of no contour recognition was not more than 10%. Herein, "no contour recognition", that is, the condition that the contour cannot be recognized, is defined in such a case that, when the threshold value at the binarization is set to be not less than 100 and not more than 150 and the surface of nitride semiconductor substrate is separated from a region except the surface at a boundary, the difference of the area of the separated region (i.e., the separated substrate surface) and the actual area of the substrate surface is within ±3% of the actual area of the substrate surface.

Referring to Table 1, when the chamfer width 15*a* is 0.5 mm, if the ratio of the surface roughness of the front surface 10 to the surface roughness of the chamfered portion 15 was not more than 0.01, the rate of no contour recognition was not more than 5%. However, if the chamfer width 15*a* is 0.9 mm and the ratio of the surface roughness of the front surface 10 to the surface roughness of the chamfered portion 15 was more than 0.01 (for example, Comparative Example 1), the rate of no contour recognition was more than 10%. This is due to that when the chamfer width 15*a* exceeds a predetermined value, the angle between the front surface 10 and the chamfered portion 15 is decreased, and simultaneously the ratio of the surface roughness of the front surface 10 to the surface roughness of the chamfered portion 15 is decreased, so that the recognition of the border between the front surface 10 and the chamfered portion 15 becomes difficult. Therefore, it is known that an area obtained by a calculation based on the binarization tends to become larger than the actual surface area.

Further, in case of Comparative Example 1 where the grinding stone having abrasive grains of small diameter as # 200 is used, the processing time for forming the chamfered portion 15 having a predetermined shape was over 6 hours. Therefore, it is preferable that the diameter of the abrasive grain is larger than that of # 200 in terms of the processing time.

Further, in case of Comparative Example 2, if the ring light source was evenly irradiated to the nitride semiconductor substrate, the contour of the substrate could be recognized. However, if the position relationship between the substrate and the light source is changed, the end surface of the substrate partially reflects the light of light source, so that there was a case that the contour of the substrate could not be recognized. Further, even though the contour of the substrate could be recognized, the contour was blurred and the rate of no contour recognition was 22%. It was considered that this is due to not having the chamfered portion 15 in the nitride semiconductor substrate according to Comparative Example 2, and an influence of shadow generated by a difference in level between the nitride semiconductor substrate and the plastic board.

As shown above, it is preferable that if the chamfer width 15*a* is not less than 0.1 mm and less than 1.0 mm, the ratio of the surface roughness of the front surface 10 to the surface roughness of the chamfered portion 15 is not more than 0.01.

Next, on the nitride semiconductor substrates according to Examples 1 to 3 and Comparative Examples 1 to 2, a gallium nitride (GaN) film of 5 μm in thickness was deposited by a metalorganic chemical vapor deposition (MOCVD) method. And, a ratio of occurrence of cracks on the surface of the nitride semiconductor substrate after the growth of the GaN film was measured. Further, trimethyl gallium (TMG) as a metalorganic material, ammonia ($NH_3$) as a gas material, and hydrogen and nitrogen as a carrier gas were used. Table 2 shows a result of the rate of occurrence of cracks of the nitride semiconductor substrates according to Examples 1 to 3 and Comparative Examples 1 to 2

TABLE 2

| | Example 1 | Example 2 | Example 3 | Comp. Ex. 1 | Comp. Ex. 2 |
|---|---|---|---|---|---|
| Chamfer width (mm) | 0.5 | 0.5 | 0.9 | 0.9 | 0.0 |
| Roughness of surface 10/ roughness of chamfered portion 15 | 0.001 | 0.01 | 0.01 | 0.03 | — |
| Rate of occurrence of cracks after growth (%) | 2 | 0 | 0 | 0 | 45 |

[Notes]
Comp. Ex.: Comparative Example

As shown with reference to Table 2, the rate of occurrence of cracks of the nitride semiconductor substrates according to Examples 1 to 3 was not more than 5%. This value gives no problems in case that actually the nitride semiconductor substrates according to Examples 1 to 3 are provided for a fabrication process of an electronic device. On the other hand, in case of the nitride semiconductor substrate according to Comparative Example 2, an abnormal growth was observed that the GaN film grows so as to rise in the periphery of the substrates due to not having the chamfered portion 15, and numerous cracks were generated from the part of the abnormal growth.

Next, Table 3 shows results of the rate of occurrence of cracks and deep scratches which occur at the chamfering due to difference of the ratio of the surface roughness of the front surface 10 to the surface roughness of the chamfered portion 15.

TABLE 3

| | Example 1 | Example 2 | Comp. Ex. 3 |
|---|---|---|---|
| Chamfer width (mm) | 0.5 | 0.5 | 0.5 |
| Roughness of surface 10/roughness of chamfered portion 15 | 0.001 | 0.01 | 0.0005 |

TABLE 3-continued

| | Example 1 | Example 2 | Comp. Ex. 3 |
|---|---|---|---|
| Rate of occurrence of cracks/deep scratches during processing (%) | 0 | 0 | 30 |

[Notes]
Comp. Ex.: Comparative Example

As seen from Comparative Example 3 in Table 3, if the chamfering is carried out by using the grinding stone 150 which is rough (for example, # 3000) in order to decrease the ratio of the surface roughness of the front surface 10 to the surface roughness of the chamfered portion 15, that is to say, to increase the ratio of the surface roughness of the chamfered portion 15 to the surface roughness of the front surface 10, large and deep scratches are easily generated in the chamfered portion 15 and breaking such as cracks is easily generated based on the generated scratches. Therefore, it is preferable that the ratio of the surface roughness of the front surface 10 to the surface roughness of the chamfered portion 15 and the ratio of the surface roughness of the front surface 20 to the surface roughness of the chamfered portion 25 are defined to not less than 0.001 and not more than 0.01.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A nitride semiconductor substrate, comprising:

a front surface;

a rear surface on an opposite side to the front surface; and a first edge portion comprising a chamfered edge on the front surface, wherein a ratio of an average surface roughness of the front surface to an average surface roughness of the first edge portion is not more than 0.01.

2. The nitride semiconductor substrate according to claim 1, further comprising:

a second edge portion comprising a chamfered edge on the rear surface, wherein a ratio of an average surface roughness of the rear surface to an average surface roughness of the second edge portion is not more than 0.01.

3. The nitride semiconductor substrate according to claim 2, wherein the first edge portion has a visible light transmissivity not more than 0.2 times that of the front surface.

4. The nitride semiconductor substrate according to claim 3, wherein the second edge portion has a visible light transmissivity not more than 0.2 times that of the rear surface.

5. A method of fabricating a nitride semiconductor substrate, comprising:

mirror finishing a front surface of a substrate comprising a nitride semiconductor; and forming a first edge portion by chamfering an edge of the front surface of the substrate, wherein the first edge portion is formed such that a ratio of an average surface roughness of the front surface to an average surface roughness of the first edge portion is not more than 0.01, and the first edge portion has a visible light transmissivity not more than 0.2 times that of the front surface.

6. The method according to claim 5, further comprising:

mirror finishing a rear surface on an opposite side to the front surface; and forming a second edge portion by chamfering an edge of the rear surface of the substrate, wherein the second edge portion is formed such that a ratio of an average surface roughness of the rear surface to an average surface roughness of the second edge portion is not more than 0.01, and the second edge portion has a visible light transmissivity not more than 0.2 times that of the rear surface.

* * * * *